US009095768B1

(12) United States Patent
Bohadi

(10) Patent No.: US 9,095,768 B1
(45) Date of Patent: Aug. 4, 2015

(54) BOARD GAME

(71) Applicant: Yousef A. E. S. M. Bohadi, Safat (KW)

(72) Inventor: Yousef A. E. S. M. Bohadi, Safat (KW)

( * ) Notice: Subject to any disclaimer, the term of this patent is extended or adjusted under 35 U.S.C. 154(b) by 0 days.

(21) Appl. No.: 14/525,215

(22) Filed: Oct. 28, 2014

(51) Int. Cl.
*A63F 3/00* (2006.01)

(52) U.S. Cl.
CPC ..... *A63F 3/00072* (2013.01); *A63F 3/00261* (2013.01); *A63F 2003/00268* (2013.01)

(58) Field of Classification Search
CPC ..... A63F 3/00072; A63F 3/00261; A63F 2003/00268
USPC ..... 273/259, 244, 254, 256
See application file for complete search history.

(56) References Cited

U.S. PATENT DOCUMENTS

| | | | |
|---|---|---|---|
| 3,404,891 | A | 10/1968 | Glass et al. |
| 4,234,186 | A | 11/1980 | Forrest et al. |
| 6,805,351 | B2 | 10/2004 | Nelson |
| 2005/0051957 | A1 | 3/2005 | Rice-Lincoln |
| 2006/0145421 | A1 | 7/2006 | Yu et al. |
| 2007/0052176 | A1 | 3/2007 | Otremba |
| 2008/0070682 | A1 | 3/2008 | Woody |

FOREIGN PATENT DOCUMENTS

| | | | |
|---|---|---|---|
| CN | 2299647 | Y | 12/1998 |

OTHER PUBLICATIONS

Duke University. Lemur Game. Retrieved on Sep. 5, 2014 from http://www.cs.duke.edu/courses/fall07/cps004/final_project_archive/aeb13/lemurgame.html.

*Primary Examiner* — Vishu Mendiratta
(74) *Attorney, Agent, or Firm* — Richard C Litman

(57) ABSTRACT

The board game includes a game board, various game pieces and a predetermined number of cards. The game is played in teams or singles, wherein each team or player represents a tribe of lemurs or monkeys trying to collect fruit. Upon determination of a game apparatus and a random selection device, a number of cards and board game gold nuggets are provided to a number of players. An objective in winning the board game is to obtain a predetermined number of matching cards or a highest winning sum total, based on the numeric value of board game points obtained by a player or team in comparison to other players and with consideration to the operations and/or instructions of other game pieces.

2 Claims, 12 Drawing Sheets

BOARD GAME

BACKGROUND OF THE INVENTION

1. Field of the Invention

The present invention relates to games that are played with a specialized apparatus, and particularly to a board game that simulates competition between tribes of monkeys fighting among each other over fruit or money and includes color cards, a three-dimensional spinner, numbered cards, game pieces, and dice.

2. Description of the Related Art

Board games are considered by many to be enjoyable, educational, and pleasurable social activities. Board games are generally entertaining and can even be used for teaching. Many popular board games are designed to encourage strategic flexibility, as well as test the nimbleness of each individual player. There is an element in the manner of play that generates delight of a player in a board game. For many players it is the perception of luck that is the driving force to play the game. Other players rely on the competitiveness and subsequent triumph as the driving force to play. For other players, the perceived level of skill to affect the outcome is key.

These board games can be used to engineer interaction among players and encourage social skill development of individuals, such as children and adolescents. However, these games do little in communicating story concept and ideas. Stories are many times used to convey values, principles, and beliefs. Stories are used to instill these values, principles, and beliefs through verbal dialog, imagination, and visual imagery. However, these stories do little to reinforce the concepts in a practical manner.

There is a need for a board game to reinforce story concepts and encourage competition in social skill development in an entertaining, practical manner. Thus, a board game solving the aforementioned problems is desired.

SUMMARY OF THE INVENTION

The board game relates to apparatuses that include a game board, various sets of cards, game pieces and a die, as well as to methods for playing the board game. The board game is intended to be played by a plurality of players. The game board has a number of regions, including card receptacles, color wheel or spinner wheel areas, round counters, and a battle zone. The game board is designed to incorporate typical movement along a game board, the use of sets of cards in game play, and various game operations based on the game apparatus and strategic thinking.

One set of cards has a front face bearing a color with a logo, icon or pictorial representation, while another set of cards has a front face bearing a numeric value. The set of cards illustrated with a type of color and a logo, icon or pictorial representation is used to depict a number of different types of monkey tribes. Another set or cards is illustrated with a numerical value and is used for quick card baffles, in which the points depicted on the cards are compared. The game board, the various game pieces, and a pre-determined number of cards are included in the board game and are used in play to simulate battle among the players or teams, and for use in keeping track of game points in play of the game.

The game may be played in teams or by independent players. In one embodiment, each team or player represents a tribe of lemurs trying to collect fruit. In an alternative embodiment, and the game apparatus and a number generator are selected so that the use of the set of a number of cards and simulated gold nuggets can be used to obtain a number of points. An objective in winning the board game is to obtain a pre-determined number of matching cards or the highest sum total of game points, based on the numerical value of points obtained by a player or team in comparison to other players and with consideration to the operations and/or instructions of other game pieces.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
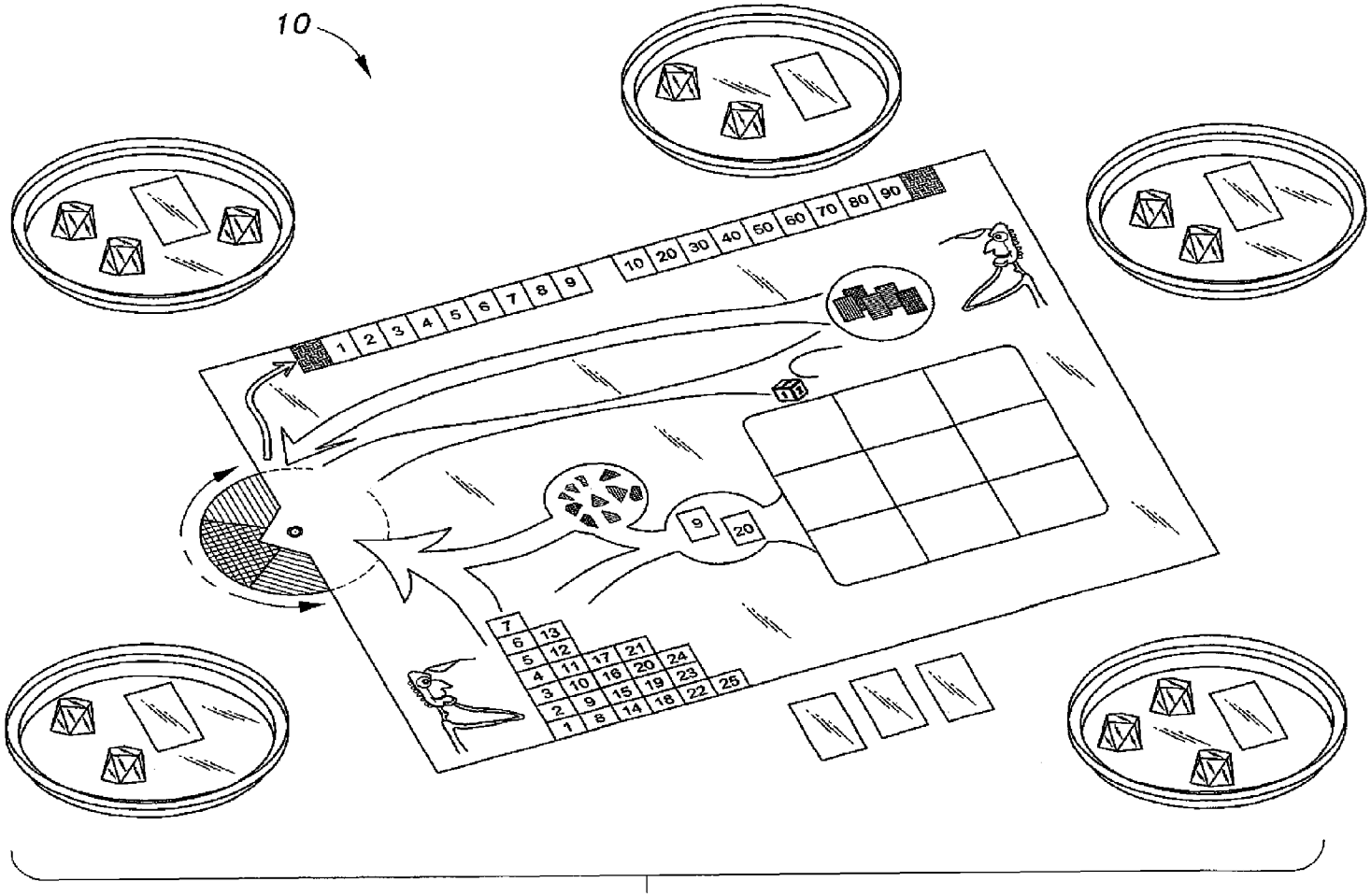
FIG. 1A is a perspective view of an exemplary board game according to the present invention.

Referring to FIG. 1A, the board game 10 may be directed to competition between a plurality of teams and adapted to be played by a plurality of users. The board game 10 provides for the specific purposes of enjoyment, amusement, and social development by those involved in playing the game. In overall concept, the board game 10 simulates the behavior of monkeys by using a game board and a plurality of game pieces to determine whether the Comorian monkey or lemur tribes fight over fruit or for gold. Although this board game 10 will be described as a simulation of monkey tribes, and in particular, monkey tribes competing in a jungle environment, the types of behavior and the judgments made regarding the goals to be attained and methods for achieving the goals parallel the behavior and the judgments made by other species, including humans, in various pursuits. Thus, the board game 10 is, at some level, an interactive, educational tool.

Figure 1B:
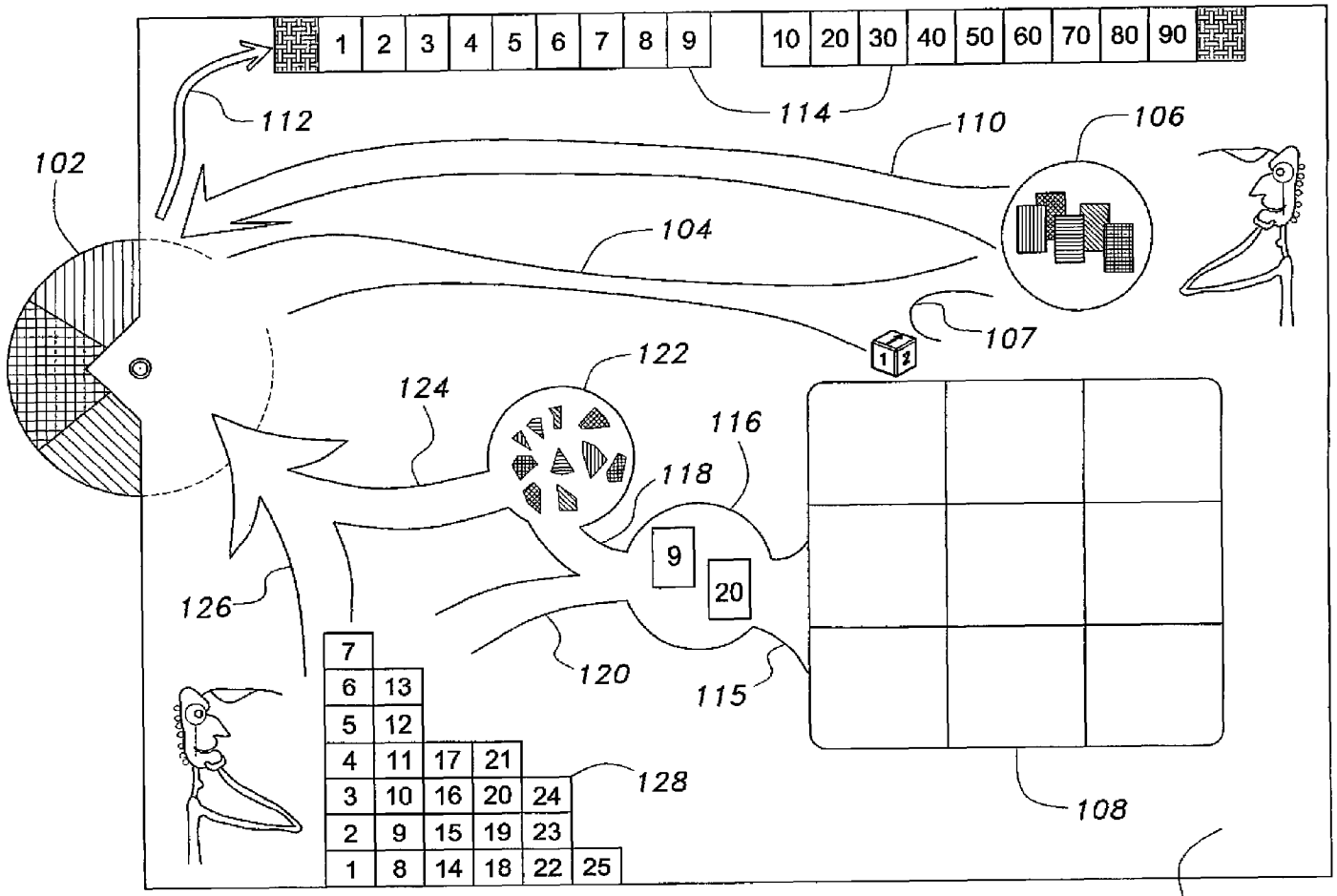
FIG. 1B is a top view of the exemplary game board shown in FIG. 1.

As shown in FIG. 1B, the board game 10 has a game board 100 having an upper surface 121 that is subdivided into a plurality of regions, paths, and battle areas or zones for use by a plurality of players. For purposes of illustration and simplicity, the typical range of the players can be from at least three players to twenty-five players, where there is a maximum of five players for each team. The apparatus, cards, objects, and game pieces used in game play of the game board 100 will be discussed in FIGS. 2A-5G. Additionally, the upper surface 121 of the game board 100 has additional areas adapted for game play selection, such as a color wheel 102 associated with the game board 100, which can be spun for random selection. The game board 100 may have a portion of its upper surface 121 projecting from an edge of the board 100 in cantilever fashion and the color wheel 102 may be rotatably mounted on an axle extending through the cantilever projection so that well over half of the area of the color wheel 102 is not subject to friction, but free to rotate, at any given moment. A portion of the bottom surface of the board may symmetrically project in cantilever fashion so that the center of the color wheel 102 may be sandwiched between the upper and lower surfaces of the game board between low friction bearings, a portion of the wheel 102 rotating in a slot between the upper and lower surfaces so that the color wheel 102 may spin freely. Moreover, other means of coupling or associating the color wheel 102 with the game board 100 can be substituted.

The functions and purposes of the regions, paths, and battle areas will be described in following paragraphs. The regions shown in FIG. 1B include a round counter 114 to keep track of the rounds played in the board game 10, a color card receptacle 106, a monkey chain receptacle 122, and a gold nugget counter 128. The number of rounds available in the round counter 114 of the board game 10 can be customizable according to agreement between the players, but the default maximum of rounds will be twenty (20), forty (40), fifty (50), and one hundred (100).

The paths that allow a player to navigate and move around the game board 100 include paths 104, 107, 110, 112, 115, 118, 120, 124, and 126. The battle zones are designated zones, such as the matrix board 108 and a numbered card zone 116 in the game board 100 where players can engage in a selected contest to advance in the game. The matrix board 108 is depicted to have a 3×3 board, but the matrix can have any size and any number of spaces can be used.

Figure 2A:
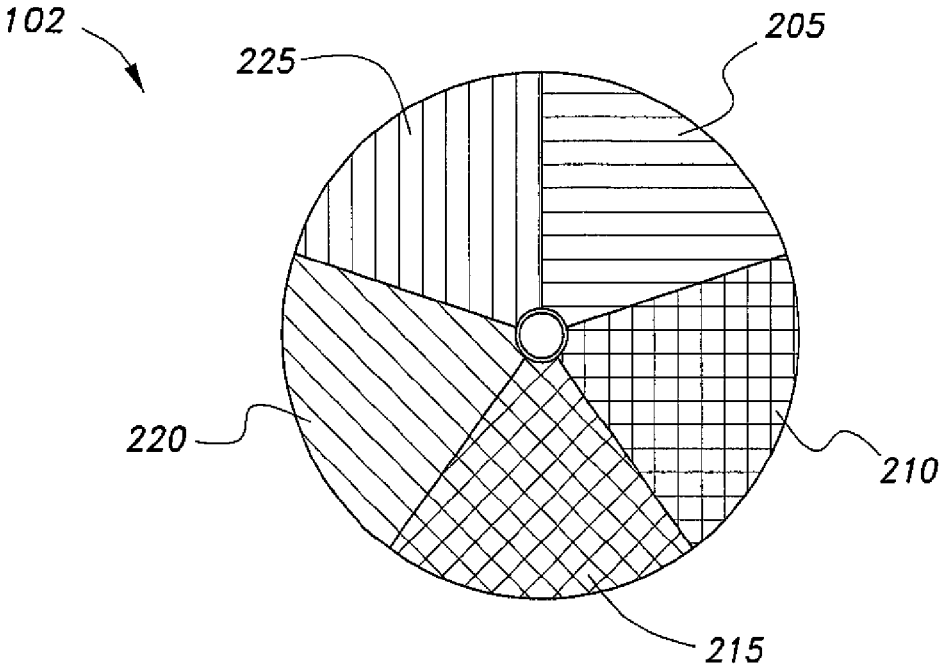
FIG. 2A is a top view of an exemplary color wheel spinner for the game board of FIG. 1, having five colors.

The apparatus, cards, objects, and game pieces for game play of the game board 100 will now be discussed. FIG. 2A illustrates the color wheel 102 in a detached form, as compared to the board-attached wheel 102 shown in FIG. 1B. The color wheel 102 is used to as a rotator or spinner for random selection of a color or tribe. Each color of the color wheel 102 shown in FIG. 2A represents a monkey or lemur tribe. Although the use of colors on a wheel is preferred and envisioned, such as the color wheel 102, it is not limited in this regard and a different means of identification of a monkey tribe can be substituted.

Figure 2B:
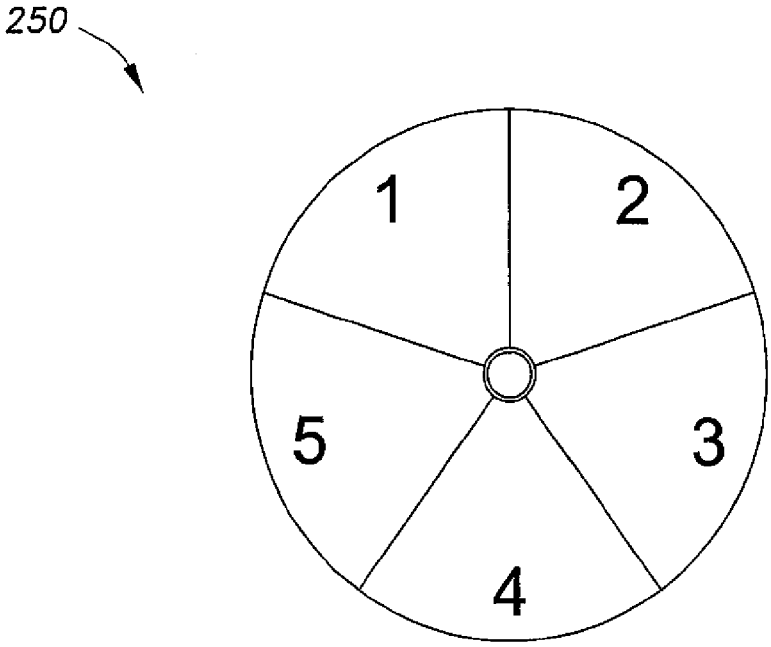
FIG. 2B is a top view of an exemplary number wheel spinner that may be used in lieu of the color wheel spinner of FIG. 2A, each section of the wheel displaying a numerical value from one through five.

FIG. 2B illustrates a number wheel 250 (not shown in FIG. 1A or FIG. 1B). The number wheel 250 illustrates a wheel similar to the color wheel 102 and can be used as a spinner for a random selection, but in this instance, the random selection is for a number, such as from numbers one through five. Although not required, the number wheel is preferred for the drawing of a card or a selection method. The card draw or a selection method can also be done by other means, such as will be discussed by either die in FIG. 5E or FIG. 5F.

Figure 3A:
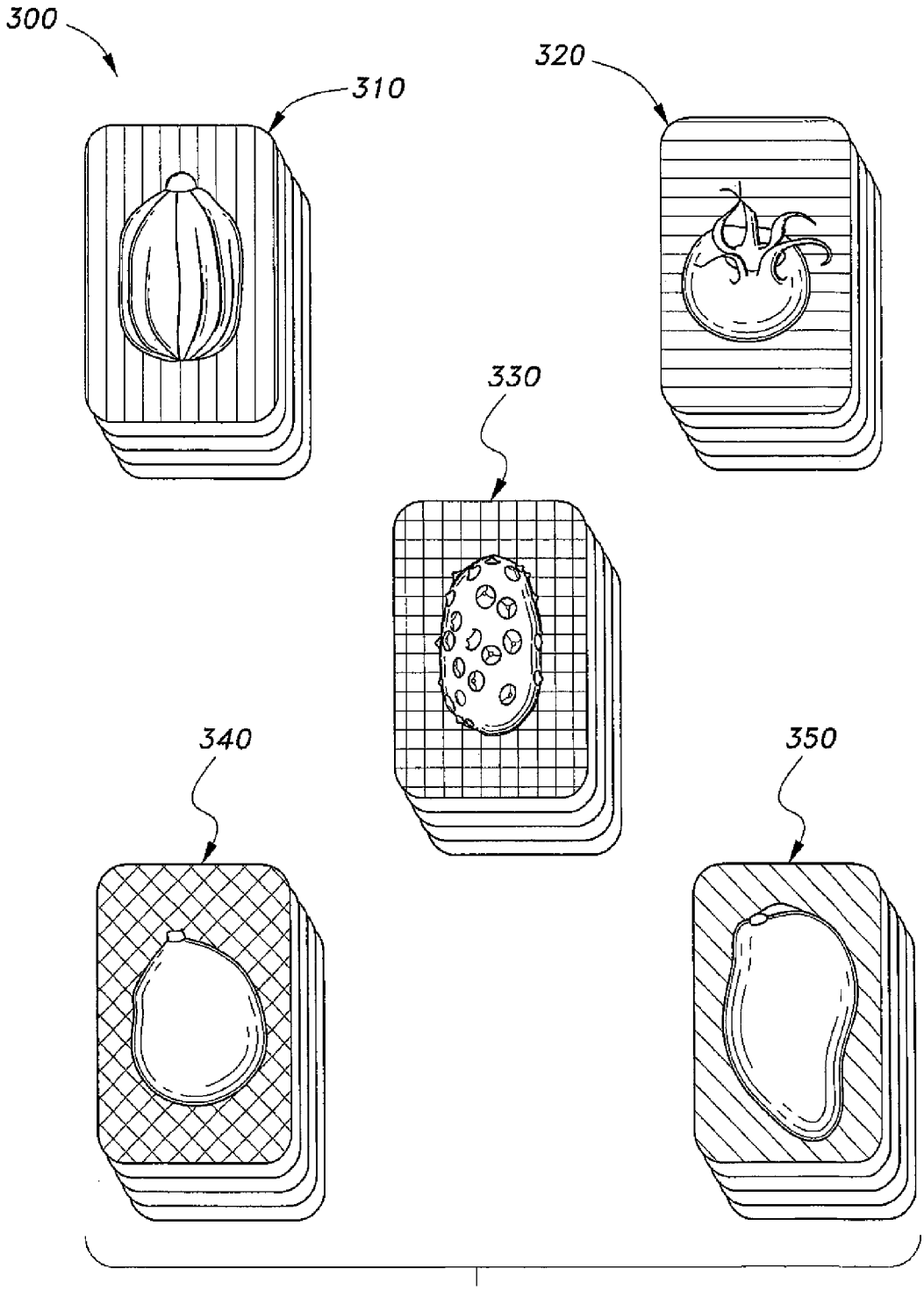
FIG. 3A illustrates a perspective view of five subsets of cards for a board game according to the present invention, the subsets being distinguished by type of fruit and background color.

FIG. 3A shows a distinct first set of cards 300, which includes a plurality of subsets of cards, such as the five subsets of cards shown in the drawings. Each subset of cards included in the distinct first set of cards 300 reflects a color, such as colors red, blue, yellow, green and orange, which is depicted on the distinct first set of cards 300 along with a logo, icon, or pictorial representation, such as a fruit. Each subset of cards included in the distinct first set of cards 300 includes a plurality of cards in each subset of cards, such as five (5) cards in each subset, or any other desired number. Additionally, each subset of cards in the distinct first set of cards 300 can have a special effect, function, or operation corresponding to the subset of cards. Each subset of cards can have the special effect, function, or operation corresponding to the subset of cards written on a face of the cards, such as the back face of card.

The first subset of cards 310 represents the color red for game play and can double the amount of points gained or lost. This doubling of lost or gained points is applicable for an entire team, whether there is one player or five players in the applicable team. As illustrated in FIG. 3A, an Ackee fruit may be shown on the front face of this first subset of cards 310.

The second subset of cards 320 represents the color blue for game play. This second subset of cards 320 allows for declining of a color card request by a player or team if the card requested is free and with a player or team holding a card, such as a blue card, from the second subset of cards 320. A card from the second subset of cards can also double the cost of points. However, it can only double the points twice and requests another team to obtain game points in order to affect the outcome of the game will count as one time. A card from this second subset of cards 320 is applicable for the entire team. As illustrated in FIG. 3A, a Medlar fruit may be shown on the front face of this first subset of cards 320.

The third subset of cards 330 represents the color yellow for game play and is used to add a monkey onto a monkey chain, such as adding a round chip to two other round chips. The monkey chain will be discussed in FIG. 5B. Any addition to a team's monkey chain by a card from the third subset of cards 330 will remain with the team, whether or not the card from the third subset of cards 330 is later removed. A card from this third subset of cards can also add any other color card to a team's possession. As illustrated in FIG. 3A, this subset of cards may have a Homed Melon fruit on the front face.

The fourth subset of cards 340 represents the color green for game play and allows a player or team to retain points, even in the event a player or team loses a numbered battle to another player or team, such as in the number battle receptacle 116 of FIG. 1B. A card from this fourth subset of cards 340 is applicable for an entire team and can only be applied a selected number of times, such as twice every ten rounds. As illustrated in FIG. 3A, the front face of this fourth subset of cards 340 may have the depiction of a Marula fruit.

The fifth subset of cards 350 represents the color orange for game play and nullifies any effect from another color cards, such as operation from the first through fourth subsets of cards, for example. A card from the fifth subset of cards 350 is applicable for an entire team and can only be applied a selected number of times, such as once every five rounds. As illustrated in FIG. 3A, the front face of this fifth subset of cards 350 may bear the depiction of a Mango fruit.

Figure 3B:
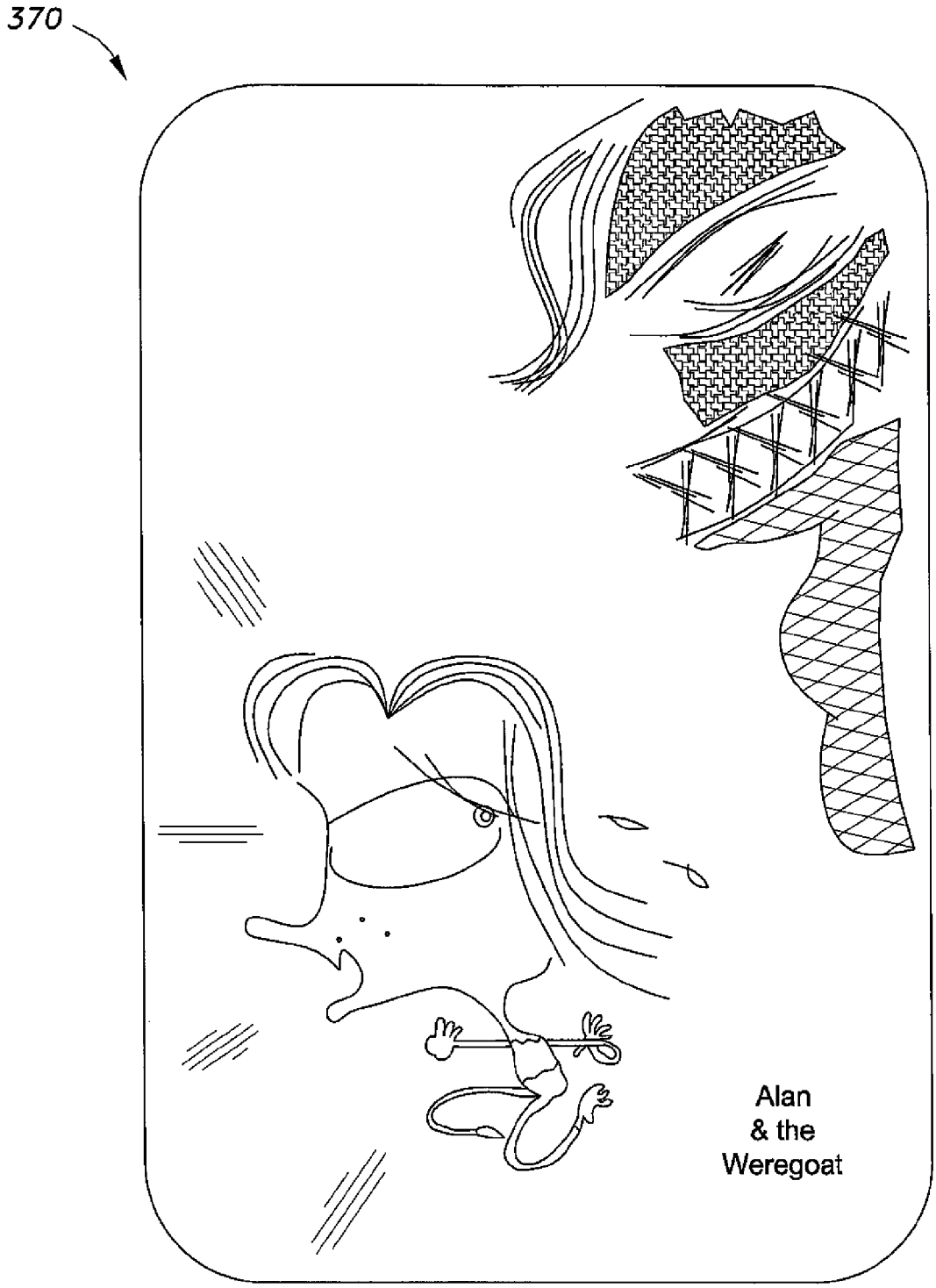
FIG. 3B is a front view of a were-goat card that may be used in a board game according to the present invention.

FIG. 3B illustrates a distinct were-goat card 370. A player or team possessing the were-goat card 370 has the ability to sweep all the color cards from other players and retain the color cards. To obtain a color card afterwards, a player or team must offer a golden monkey chain when it is the offering player or team's turn to play. The golden monkey chain substitutes for the normal color monkey chains and provide an opportunity to choose any of the color cards taken by the were-goat card 370.

Figure 4:
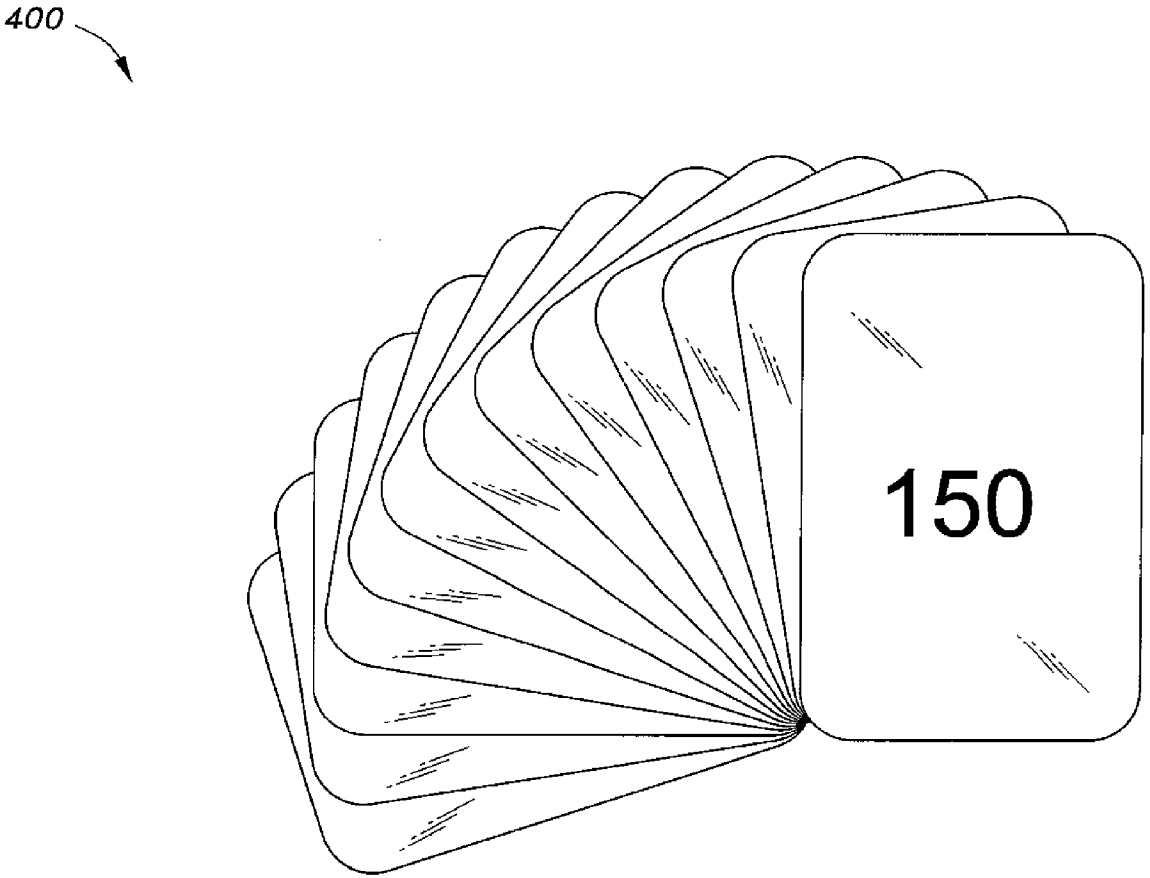
FIG. 4 is a top view of a set of cards displaying numerical values of one through one hundred-fifty that may be used in a board game according to the present invention.

Referring to FIG. 4, there is illustrated a plurality of numbered cards for game play in connection with the game board 100. The numbered cards are a second set of cards 400 having, for example, one hundred and fifty (150) cards (but can have more or fewer cards) forming the second set of cards. Each card in the second set of cards 400 can have on a front face a numeric value ranging from, for example, the number one ("1") through one hundred and fifty ("150").

Figure 5A:
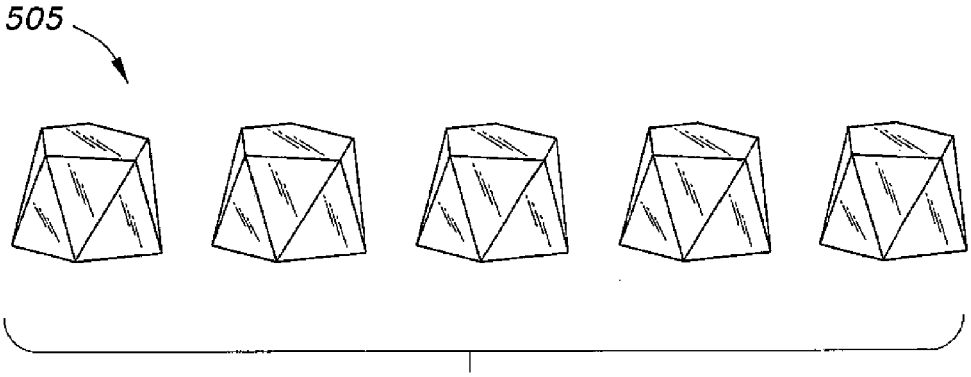
FIG. 5A is a perspective view of gold nugget game pieces that may be used in a board game according to the present invention.

FIGS. 5A to 5H show a number of game pieces that are used in play of the board game 10. FIG. 5A illustrates a plurality of gold nuggets 505 for use in play of the board game 100. The plurality of gold nuggets 505 can be any number of gold nuggets for play of the game, e.g., one hundred gold nuggets 505, and is not limited in this regard. The gold nuggets 505 are preferably used to account for game points, and each gold nugget 505 from the plurality of gold nuggets 505 can be accredited a numeric value of points, such as one game point.

Figure 5B:
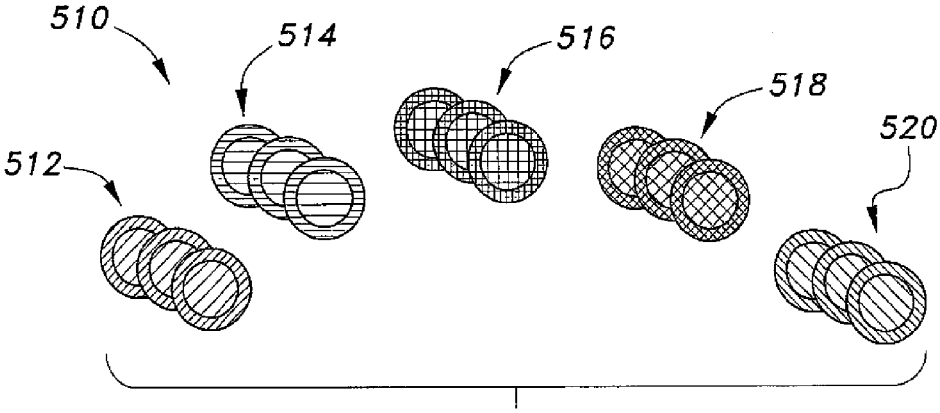
FIG. 5B is a front view of round chip game pieces representing monkey chains of different colors that may be used in a board game according to the present invention.

FIG. 5B depicts a plurality of round chips 510 for use in play of the game. The plurality of round chips 510 represent monkey chains in play of the board game. The plurality of round chips 510 can be any number of rounds chips, but it is desirable to have a chain of at least three (3) round chips corresponding to each subset of cards in FIG. 3A. Each of the at least three (3) round chips corresponding to each subset of cards in FIG. 3A will display the color of the subset of cards it corresponds to. For example, round chips 512 correspond to the first subset of cards 310, representing the color red; round chips 514 correspond to the second subset of cards 320, representing the color blue; round chips 516 correspond to the third subset of cards 330, representing the color yellow; round chips 518 correspond to the fourth subset of cards 340, representing the color green; and round chips 520 correspond to the fifth subset of cards 350, representing the color orange.

Figure 5C:
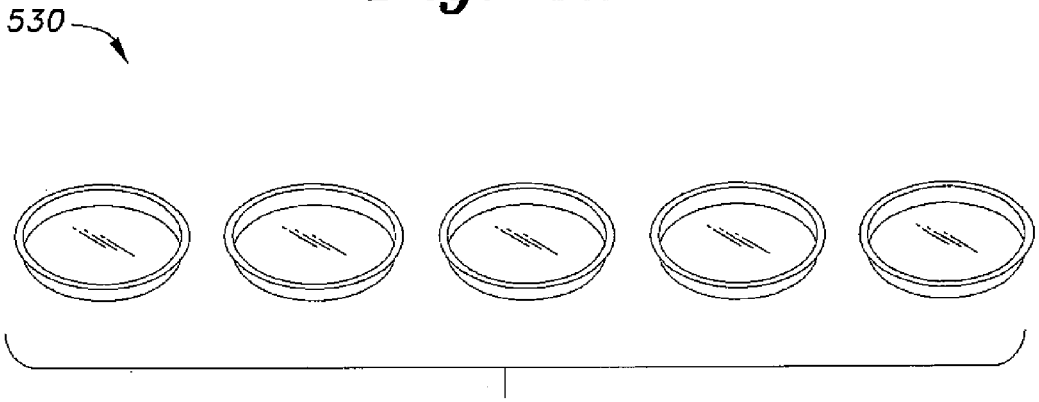
FIG. 5C is a perspective view of pot game pieces that may be used in a board game according to the present invention.

FIG. 5C depicts a plurality of pots 530, such as five (5) pots, for use in play of the game. The plurality of pots 530 can be used to contain at least one set of cards, such as the first set of cards 300, and at least one game piece, such as gold nuggets from the plurality of gold nuggets 505.

Figure 5D:
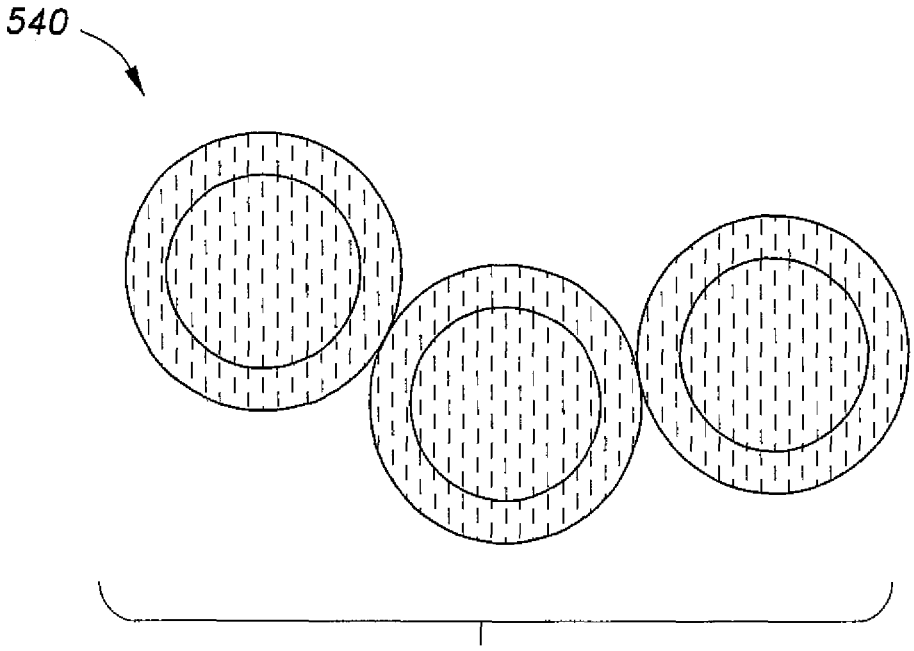
FIG. 5D is a front view of round chip game pieces representing golden monkey chains that may be used in a board game according to the present invention.

FIG. 5D illustrates a plurality of round chips representing golden monkey chains 540 for use in play of the game. The plurality of golden monkey chains 540 can be any number for play of the game and is not limited in this regard. However, for purposes of illustration of the present embodiment, the maximum number of golden monkey chains for use in play of the role playing board game will be five (5). A golden monkey chain is used in conjunction with a number of points, and can be used to summon the distinct were-goat card 370.

Figure 5E:
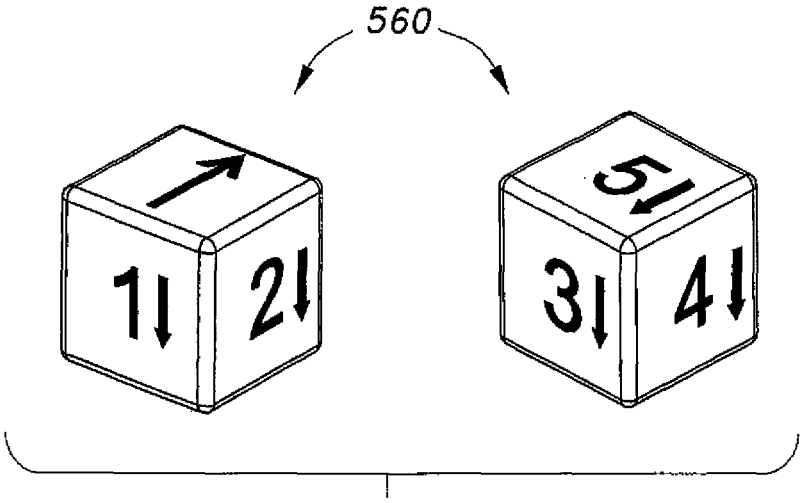
FIG. 5E is a perspective view of dice with numerals and arrows that may be used in a board game according to the present invention.

FIG. 5E depicts a die 560 for use in play of the board game 10. Two such dice are shown in FIG. 5E in order to illustrate the six sides of the die 560, although only one die 560 is used in play of the board game 10. Five of the six sides can display a number, such a number one ("1"), preferably ranging from one through five, and a downward arrow adjacent to the displayed number for each. The sixth side of the die 560 can display an upward arrow. The die 560 can be used to select a team or player. For example, if the die is rolled and lands on the side with the number one ("1"), then player one or team one will be selected for play. When the die lands and shows the upward arrow, the player or team with the highest numbered card will be selected, such as the team with a numbered card of one hundred and fifty ("150") from the second subset of cards 400. The player or team with the highest card will be selected, and the game play for all players or teams will continue from the right of the player or team selected.

Figure 5F:
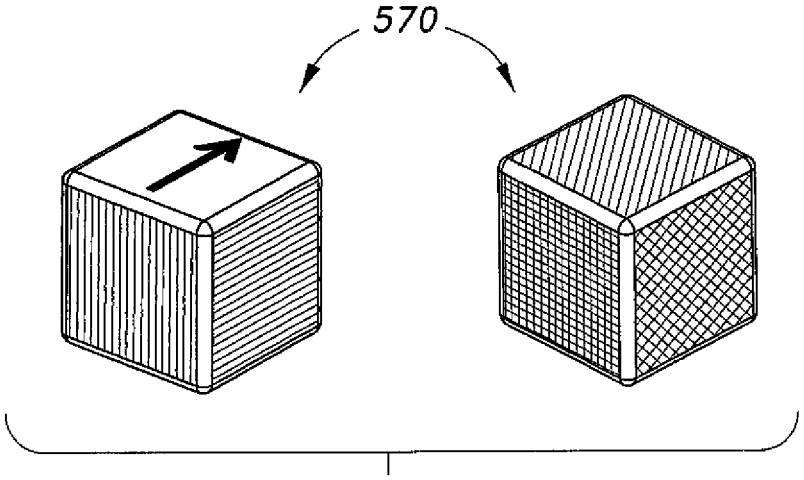
FIG. 5F is a perspective view of a multicolored dice that may be used in a board game according to the present invention.

FIG. 5F depicts a multicolored die 570 for use in play of the game. FIG. 5F shows two such dice in order to illustrate the six sides of the die 570, although only one die 570 is used in play of the game. Five of the six sides can display a color, such as the colors red, blue, yellow, green and orange, and the sixth side can display an upward arrow. For example, if the die is rolled and lands on the side with the color red, then the player or team whose tribe or color is represented by red will be selected.

Figure 5G:
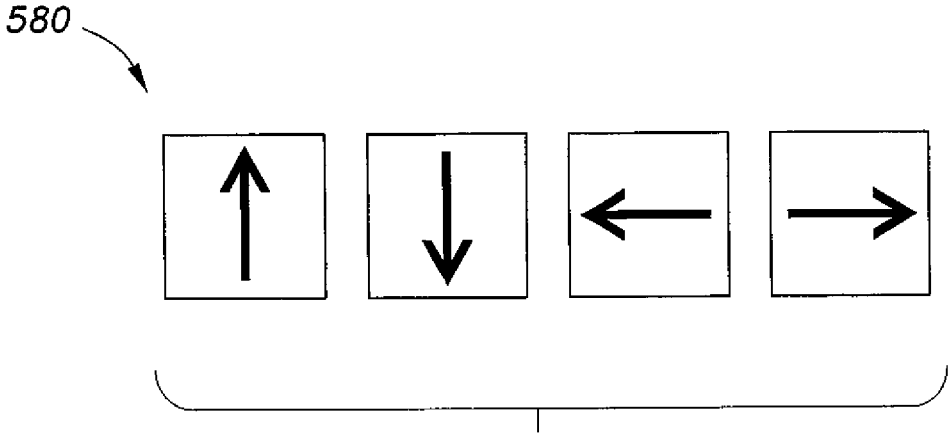
FIG. 5G is a front view of a plurality of arrow tiles that may be used in a board game according to the present invention.

FIG. 5G portrays a plurality of arrow tiles 580 for a block flow battle between players or teams on the matrix board 108 in the play of board game 10 of FIG. 1B. The plurality of arrow tiles 580 can be any number of arrow tiles for play of the game and is not limited in this regard. However, it is desirable to have a sufficient number of tiles to fill each space of a matrix board, such as having nine (9) arrow tiles to fill the nine (9) spaces of the 3×3 matrix board 108.

Figure 6A:
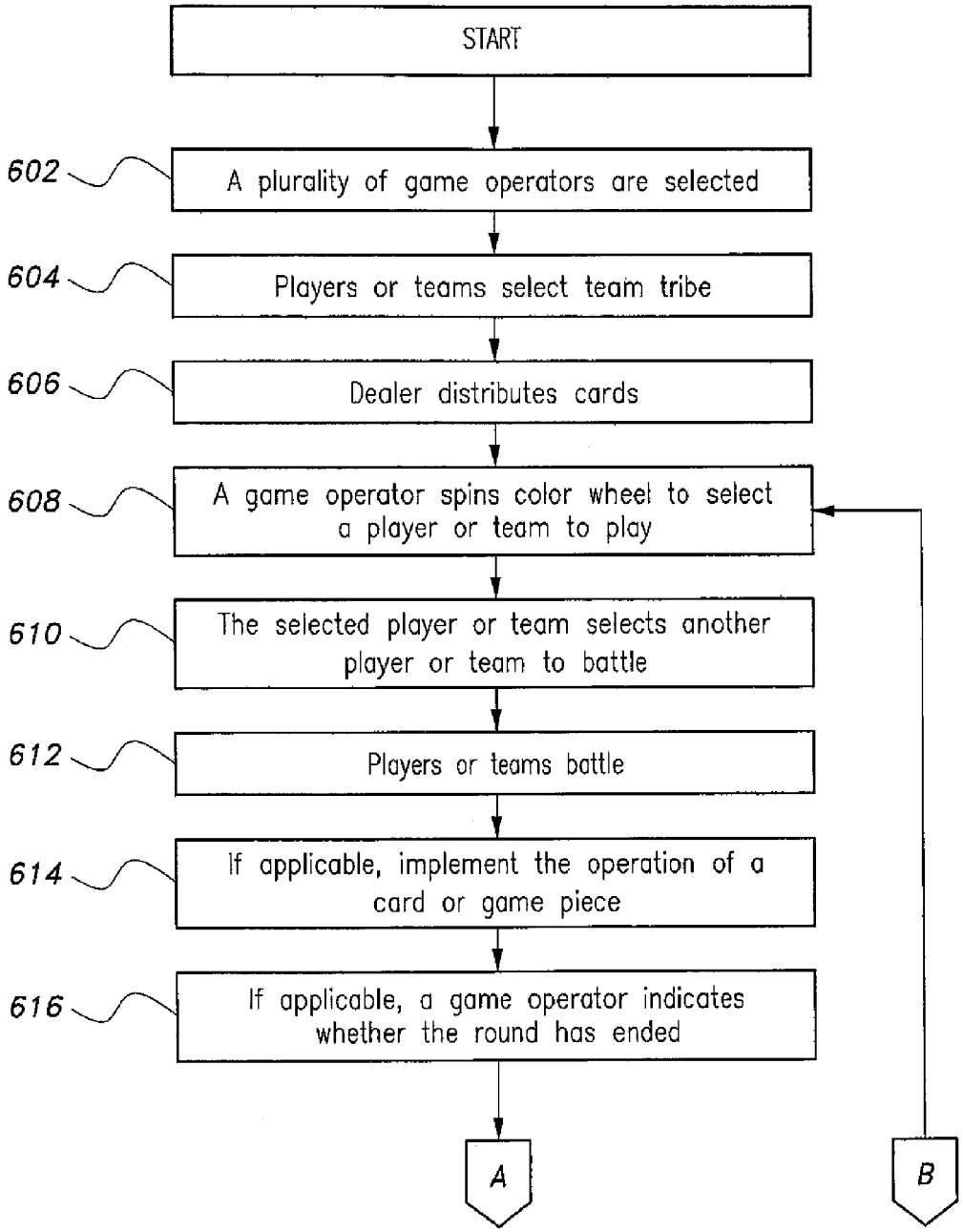
FIGS. 6A and 6B are a flowchart of a method for playing a board game according to the present invention.
Figure 6B:
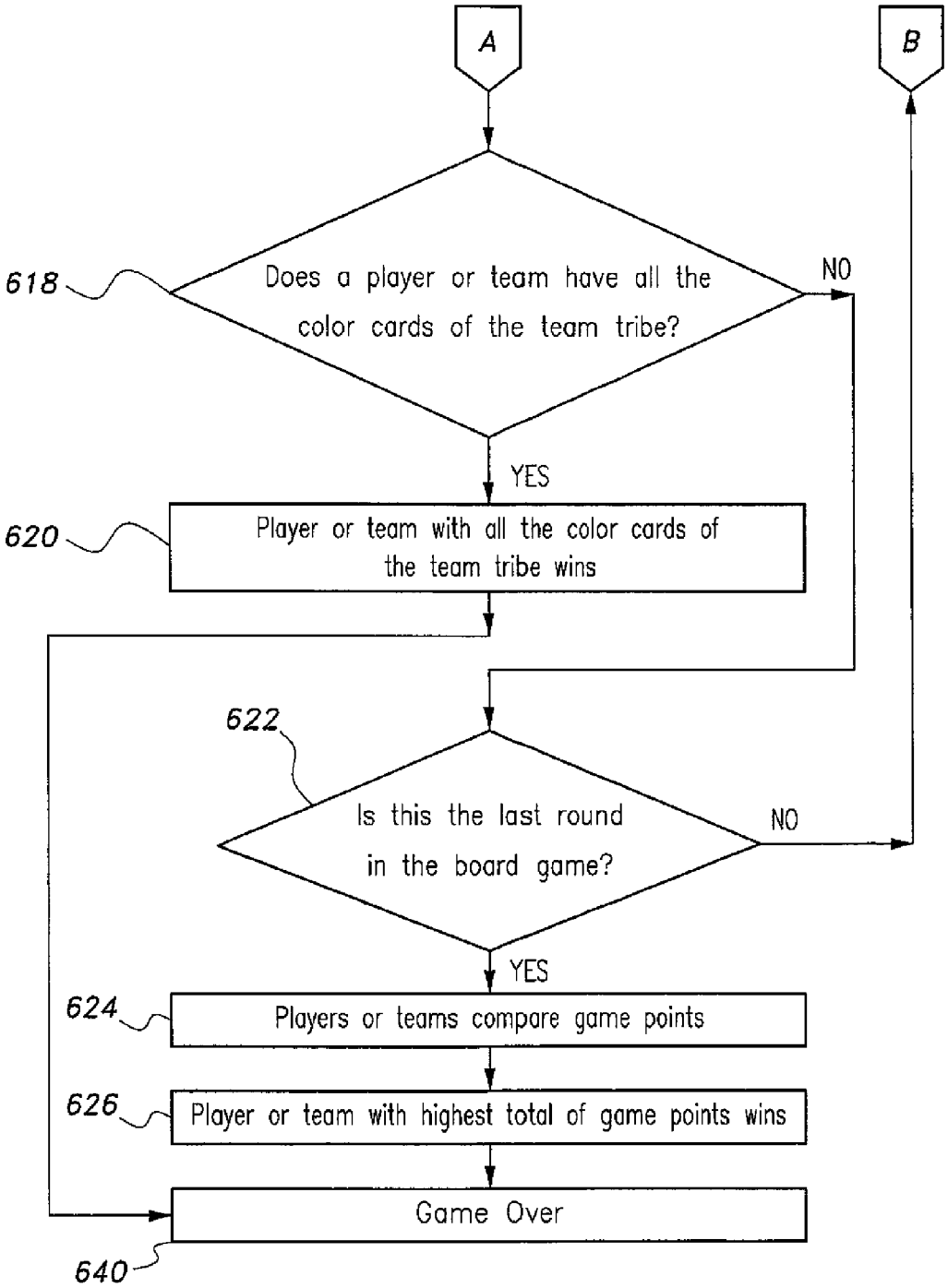

FIG. 6A and FIG. 6B are a flowchart showing the steps in a method of playing the board game 10 using the game board 100 and the apparatus, cards, objects, and game pieces illustrated in FIGS. 2A-5G. An objective to winning the board game is to obtain all the color cards of one color, or to obtain the highest total of points, after the end of all the rounds. In order to win the board game 10, a player must adhere to and follow the rules of the board game 10, accordingly. Exemplary non-comprehensive rules for playing the board game 10 are presented in Table 1.

TABLE 1

| Basic Rules of Play | |
|---|---|
| Rule 1 | The sets of cards include a plurality of cards. For example, the number of cards in the sets of cards is one hundred seventy-six (176). |
| Rule 2 | There can be a plurality of players involved in the board game. For purposes of illustration and simplicity, the typical range of the players can be from three to twenty-five players but is not limited in this regard. |
| Rule 3 | The game can be played in teams or in singles. |
| Rule 4 | There must be as equal number of players per team as possible. A team will redistribute its team members among other teams to create a more equal number in each team. |
| Rule 5 | There is a dealer. For purposes of illustration and simplicity, the dealer will be a human dealer. |
| Rule 6 | Each player is given a predetermined number of cards. For purposes of illustration and simplicity, the number of cards to be dealt to each player will be five. |
| Rule 7 | After each player is given a predetermined number of cards from a set of cards, the remaining cards from that set of cards are placed in a withdrawing deck. This deck will be the cards that a player will draw additional cards from. |
| Rule 8 | Each spin of a wheel can be determined as one round. For example, each spin of the color wheel is a round of play in the board game. |
| Rule 9 | The maximum number of rounds for game play can be customized, such as based on an agreement among the players or teams. |
| Rule 10 | A die is used to decide the opposing team for challenging the opposing team. |
| Rule 11 | No player in a team can collect an additional color card of that team's color if another player in that team does not have possession of at least one color of that team's color, unless by implemented by operation of a card or game piece. |
| Rule 12 | There are a maximum number of monkey chains per color |

TABLE 1-continued

| Basic Rules of Play | |
|---|---|
| | or tribe. For purposes of illustration and simplicity, the number of monkey chains per color or tribe will be two, except a third monkey chain with a letter "S". |
| Rule 13 | There is a third monkey chain that has a letter "S" on it for each color card that is used by a player or team of the yellow color cards. |
| Rule 14 | There are a maximum number of golden monkey chains. For purposes of illustration and simplicity, the number of golden monkey chains will be five. |
| Rule 15 | A player or team can have a maximum number of golden chains. For purposes of illustration and simplicity, the number of golden monkey chains a player or team can have will be three. |
| Rule 16 | Players must follow the instruction or operation of another player's card or game piece that can be implemented against their own cards or game pieces. |
| Rule 17 | Each gold nugget represents a number of game points. For purposes of illustration and simplicity, each gold nugget represents one game point. |
| Rule 18 | The game ends once a player or team wins. |

Once a player or team has the highest total of points based on numeric value points at the end of all the rounds or obtains all the color cards in one color, based on one or more calculations, functions or operations of cards and game pieces, that player or team wins the game and the game is over. For example, roles are assigned to a number of players for play of the game at step 602. The assigned roles include a dealer to shuffle and deal cards (such as the second set of cards 400), a person to keep count of the rounds, and a person to operate the color wheel 102. While is it is described as several roles, one person can be selected for all the roles.

At step 604, players or teams can select team tribes. A player, team, or tribe can be represented by a color and/or pictorial representation, such as a player or team acting as tribe represented by a card from the distinct first set of cards 300. This can be done by performing a card battle where every player or team can select one number card from the second set of cards 400. Each player or team will then show he/her/their selected number card, and the player or team with the highest number card shown will select his/her/their team first, the player or team with the second highest number will then select his/her/their team next, and so on.

After selection of the team tribes by the players or teams, and once the person assigned as the dealer has shuffled the numbered cards, the dealer deals out a predetermined number of cards to each player at step 606. For example, after the cards of the second set of cards 400 are shuffled, the dealer deals out five cards from the second set of cards 400 to each player at step 606, and the remainder of the cards from the second set of cards 400 are placed in the convenient location in relation to the players to form a battle withdrawing deck. The dealer can also distribute a predetermined number of color cards from the distinct first set of cards 300 to each player at step 606 and create a tribe withdrawing deck from the remainder of cards from the distinct first set of cards 300 not distributed among the players.

The dealer or another game operator initiates play of the game at step 608, spinning the color wheel to select a player or team to begin play of the game. Any player can be selected as a game operator to spin a color wheel, such as the color wheel 102, including a player who won a previous game. Once a player or team is selected, the selected player or team can choose another player or team at step 610 to battle as one tribe against another tribe.

The selected player or team can choose another player or team in a number of ways. For example, a player or team can be chosen by a numbered cards battle, such as was done at step 604 for the players or teams to choose a team tribe. However, in this instance, the battle is completed among the remaining players or teams, and the player or team with the highest card is the selected player or team to battle against the team selected at step 608. Another method of choosing another player or team to battle is by rolling a die, such as the die 560 or the multicolored die 570. The selected player or team chosen at step 608 can choose another player or team to battle by rolling the die 560 or the die 570 and choosing the player or team according to the number or color the die lands on. For example, if the die 560 is rolled and lands on the number 3, which corresponds to the player or team representing the third tribe, then the opposing player or team is the third tribe. Or, if the die 570 is rolled and lands on the green side corresponding to the player or team, corresponding to the tribe associated with the color green, then the opposing player or team is the green tribe.

If the die is rolled and it lands on the already selected team at step 608, then all the other players or teams will show a numbered card from the player's or team's possession. The player or team with the lowest numbered card shown will battle with the already selected team. If the die lands on the upward arrow, as shown on either die 560 or die 570, then the player or team who has the highest number card in his/her/their possession is chosen.

Once the player or team has been selected at step 610, then the players or teams will battle at step 612. The players or teams can engage in a simulated battle as monkey or lemur tribes fighting one another. In the simulated role play, the players or teams can "battle" each other in a number of ways. For example, the players or teams can battle by engaging in a numbered battle or numbered card battle. The numbered battle can be engaged in with numbered cards from the second set of cards 400, and also with a flow block game using the arrow tiles 580 and the matrix board 108 of the game board 100. In the flow block game, the player or team the color wheel 102 initially selected will start first with the majority of the arrow tiles, such as being given five (5) arrow tiles, and the opposing player or team will receive four (4) arrow tiles. The goal of the flow block game is to form as many connected arrows showing a flow direction as possible. The players or teams involved in the flow block game will take turns placing an arrow tile 580 on the matrix board 108, beginning with the team that has five (5) arrow tiles. However, if the player or team selected at step 610 was as a result of the of the die 560 or the die 570 landing on the upward arrow, then that player or team will begin first.

The player or teams can block the flow of direction of the arrow tiles of the opposing team by placing his/her/their tribe's arrow in the opponent's way in the opposite direction. Once all the blocks in the matrix board 108 are filled, then each player or team will count the number of connected arrow tiles, and the player or team with the highest number will determine how many numbered cards from the second set of cards 400 the player or team's player will use. In the instance where there is more than one player in a team, then the team will choose a player to represent the team (tribe) for a numbered card battle, i.e., comparing at least one numbered card from the second set of cards 400 against at least one numbered card from an opposing player or team. This numbered card battle can take place on a location on the game board 100, such as the numbered card zone 116.

The player selected by the team will select a number of cards based on the number of connected arrow tiles against a designated number of cards against a player in the opposing team. Each player will play the numbered battle game at step 612, where the highest point total is added to each player or team's tribe total number of points, and a total number of wins or losses will be added to the tribe's wins or losses. The numbered battle can be repeated by each player in a team against another player in the opposing team until all players have played the numbered battle against another player in the opposing team. The players, teammates or tribe members of each team or tribe can use the same number of cards as allowed by the player representative in the flow block game. The conclusion of the flow block game will be based on the total wins of the two teams, such as after all the wins from the players in each team have been calculated. If both teams have the same number of wins, then the player or team with highest point total obtained from the numbered battles wins. If there is still a tie, the players are given new cards from the withdrawing deck from the second set of cards 400 and will play until there is a winner for that round.

After a winner is determined for that round, the numbered cards from the second set of cards 400 used in the numbered battle are returned to the withdrawing deck. The winner of the numbered battle can choose between obtaining game points, such as represented by the gold nuggets 505, and filling a monkey chain. It is important to note that each player or team representing a color or tribe has two (2) empty monkey chains, such as a number of the round chips 520, in the beginning. Winning a numbered battle will enable a player or team to obtain game points or a monkey chain. While an objective of winning the board game is to obtain a predetermined number of matching cards, such as all the color cards in a tribe or a highest total of game points, once a monkey chain is filled, it will protect a player or team's color cards, such as in the case of another player implementing an operation that could remove a number of a tribe's color cards.

For example, and if applicable, at step 614 a player or team can implement the operation of a card or game piece of the board 10 and can collect all the color cards by summoning the were-goat card 370. To summon the were-goat card 370, a player or team must have three (3) golden monkey chains 540 and use three (3) points of his/her/their own and say "Alan saw the were-goat!" However, if a player or team offers a monkey chain to the player or team possessing the were-goat card 370, then the player or team offering the monkey chain can select and obtain any of the color cards in the possession of the player or team who has possession of the were-goat card 370.

Continuing the play of the board game at step 616, and if applicable, a game operator, such as the dealer or another player selected for this role, can indicate whether the round has ended. This can be determined, for example, by tracking the player or team that won the numbered card battle and/or whether the color wheel 102 was rotated again. After it has been determined the round has ended, any player or team can check whether the tribe has all the color cards of the team tribe at step 618. If the player or team does have all the color cards of the team tribe, that player or team wins at step 620 and the game is over at step 640.

If a player or team does not have all the color cards of the team tribe, the play of the game proceeds to step 622. At step 622, it can be checked, such as by the dealer or another player selected for this role, whether the round is the last round in the board game. If the round is the last round in the board game, then the players or teams can compare game points, such as adjusted by various cards or game pieces, to calculate a sum total of game points for each tribe at step 624. The player or team of the tribe with the highest total of game points wins at step 626 and the game is over at step 640.

Figure 7:
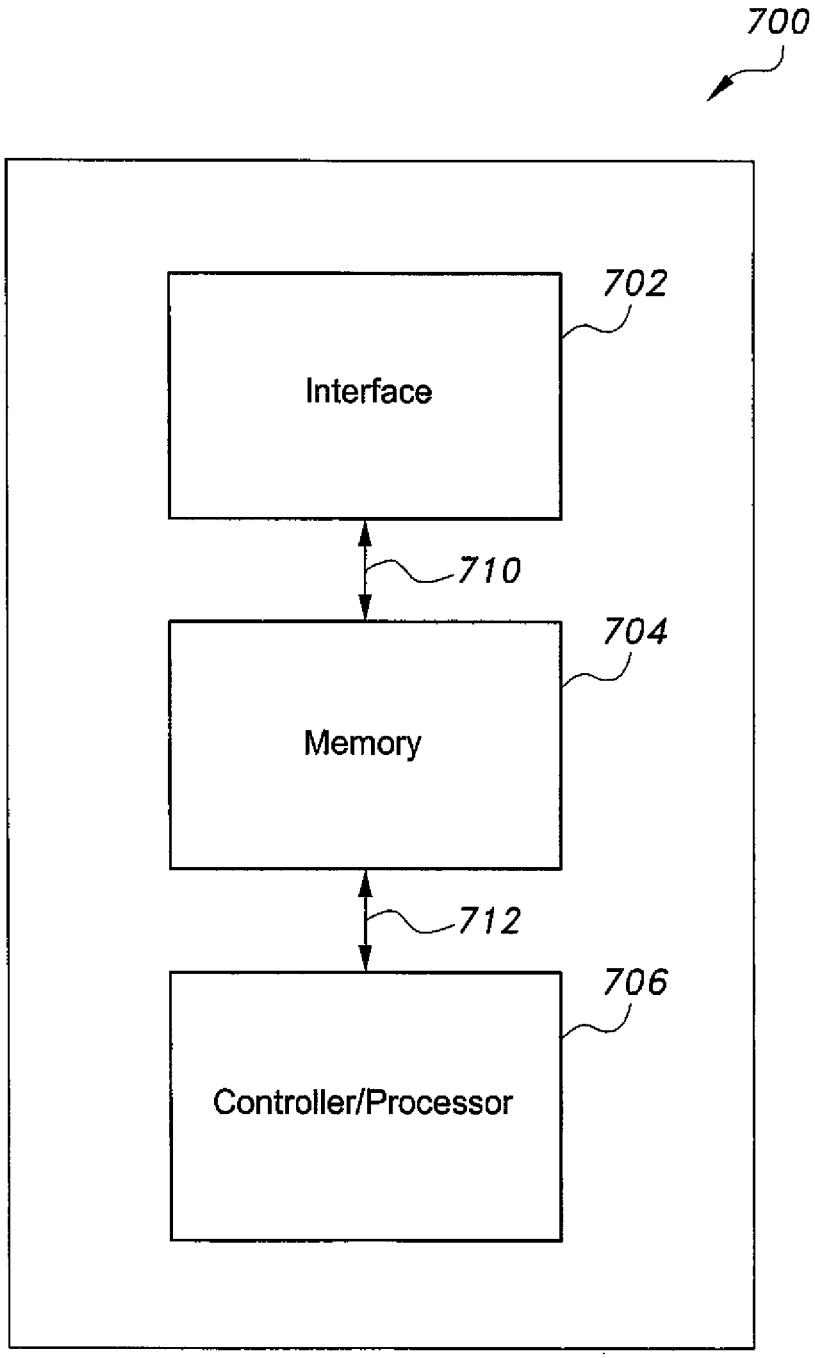
FIG. 7 is a block diagram of a general purpose computing system for an electronic embodiment of a board game according to the present invention.

Referring to FIG. 7, there is illustrated a generalized system 700, such as can be included in a computer-implemented device, as can be used for implementing embodiments of the board game 10 in a computing environment, including processors, controllers, and memories, for example. Also, it should be understood that the generalized system 700 can be any type of computer-implemented device and can represent, for example, a processor, a controller, a stand-alone computer, a mobile computing device, computer terminal, networked computer terminal, or a networked portable device.

In FIG. 7, the generalized system 700 includes an interface 702, a memory 704, and a controller/processor 706, for example. Information related to, data for, and instructions for implementing execution for play of the board game 10 can be acquired by or provided through the interface 702 through a network, such as the Internet, an intranet, or a wireless network, and stored at 710 in the memory 704, such as a computer readable memory, which can be any suitable type of computer readable and programmable memory.

Examples of computer readable media that can be used or included in the memory 704 can include a non-transitory computer readable storage memory, a magnetic recording apparatus, an optical disk, a magneto-optical disk, and/or a semiconductor memory (for example, RAM, ROM, etc.). Examples of magnetic recording apparatus that may be used in addition to memory 704, or in place of the memory 704, include a hard disk device (HDD), a flexible disk (FD), and a magnetic tape (MT). Examples of the optical disk include a DVD (Digital Versatile Disc), a DVD-RAM, a CD-ROM (Compact Disc-Read Only Memory), and a CD-R (Recordable)/RW.

For example, information or data can be transmitted from or received by the interface 702, such as received instructions from a player or team or operations performed by the processor according to a computer program. Such information or data can be organized in the memory 704 and transmitted to or from the memory 704, such as a computer readable memory, at 712 to the controller/processor 706 or at 710 to the interface 702.

Operations, calculations, decisions or determinations can be performed by the controller/processor 706, which can be any suitable type of computer processor, as discussed. Also, the resulting information, resulting data or resulting determination made by the controller/processor 706 from the information or data processed by the controller/processor 706 can be stored in the memory 704 and can be transmitted through the interface 702, such as to one or more of the controllers or processors, such as a client-server model, in an online board game, to implement a game procedure or to provide information or data to be displayed on an interface or output device, such as a computer display, digital display or digital screen that is capable of being used for input, in addition to outputting or presenting information to a plurality of users.

The board game and the accompanying sets of cards, game pieces, and apparatuses can therefore be a virtual "board game." The computer application includes hardware, such as can include processors and memory. Also, an example of an algorithm and software instructions for adapting and implementing the processes and methods are illustrated and described in the method illustrated in the flowchart of FIGS. 6A and 6B.

For example, when the board game is implemented as a computer or digital game, one player can be human and at least one player can be the computer itself. The human player can interact with the computer player as the human player would with any other player. In addition to interacting with the computer player, the human player may also interact with one or more players in various locations through a networking system, such as a local or global computer communication system, and can be displayed to one or more players of the on an output device, such as a digital display.

It is to be understood that the present invention is not limited to the embodiments described above, but encompasses any and all embodiments within the scope of the following claims.

I claim:

1. A method for playing an electronic board game, the method comprising executing, with a processor, a program stored in a non-transitory memory of a computer implemented device, the program directing the computer implemented device to perform the following:

(a) generating onto an output device:

a. a selection of the number of players to play the board game and for each player to designate a respective tribe;

b. a game board having a number of defined areas;

c. a plurality of numbered cards, each of the numbered cards depicting a numeric value;

d. a plurality of game pots for assignment to the selected players;

e. a plurality of gold nugget game pieces, each gold nugget game piece assigned a distinct numeric game point value;

f. a first plurality of monkey chains each comprising a predetermined number of round chips, the plurality of monkey chains being equal to the plurality of colored color cards;

g. a second plurality of monkey chains, the second plurality of monkey chains not associated with the colored color cards;

h. a plurality of directional arrow tiles with the plurality of arrow tiles;

i. at least one random color generator associated with the game board;

j. at least one die associated with the game board, wherein the die includes indicia for generating a random number, color designation or icon; and k. a plurality of distinct colored color cards, each of the color cards has a distinct special indicia thereon, the indicia being selected from the group consisting of a first set of colored color cards indicating an operation to affect the numeric value of game points accredited to at least one player, a second set of colored color cards indicating an operation to reduce the amount of game points accredited to at least one player; a third set of colored color cards indicating an operation to add a monkey on to a monkey chain or add another colored color card to a player's possession, a fourth set of colored color cards indicating an operation to retain points after loss of a numbered card battle, and a fifth set of colored color cards indicating an operation to nullify any operation from the first through fourth sets of colored color cards;

(b) designating a predetermined number of matching color cards for a player to win the board game;

(c) dealing a plurality of distinct first set of color cards to each player;

(d) dealing a plurality of numbered cards to each player to form a hand for each player;

(e) designating at least one player to generate a color for selection of a first player;

(f) designating the first player to select at least one additional player to engage in a battle, wherein the additional player is selected from the group consisting of a numeric card and a die;

(g) comparing the numeric value of the card or the die indicia of the first player and the additional player to determine an order of battle;

(h) determining whether an operation is necessary and when it is determined the operation is necessary, performing the operation by either the first or additional player;

(i) selectively determining whether either the first or additional player has the predetermined number of colored color cards, and when it is determined either the first or additional player has the predetermined number of colored color cards, designating the first or additional player as the winner of the game, wherein the winner is awarded at least one gold nugget game piece with its associated distinct numeric game point value;

(j) selectively determining whether it is the last round of the game, and when it is determined it is the last round of the game, comparing a total number of game points of the first or additional player with the highest total number of game points as the winner of the game, wherein a combination of a plurality of the color cards, a plurality of the numbered cards, a plurality of the monkey chains, and a plurality of the arrow tiles by a player corresponds to a sum point total of game points for the player; and (k) executing steps (d) through (j) until a player has the predetermined number of colored color cards or the highest total number of game points.

2. The method according to claim 1, wherein the program including instructions executed by the processor directs the computer implemented device to further perform the following:

displaying by a digital display information related to the electronic board game.

* * * * *